US010605122B2

(12) United States Patent
Hume et al.

(10) Patent No.: US 10,605,122 B2
(45) Date of Patent: Mar. 31, 2020

(54) REHEATING OF A WORKING FLUID WITHIN A TURBINE SYSTEM FOR POWER GENERATION

(71) Applicant: Electric Power Research Institute, Inc., Charlotte, NC (US)

(72) Inventors: Scott Alexander Hume, Cornelius, NC (US); David Thimsen, Little Canada, MN (US)

(73) Assignee: ELECTRIC POWER RESEARCH INSTITUTE, INC., Charlotte, NC (US)

( * ) Notice: Subject to any disclaimer, the term of this patent is extended or adjusted under 35 U.S.C. 154(b) by 122 days.

(21) Appl. No.: 15/553,296

(22) PCT Filed: Feb. 26, 2016

(86) PCT No.: PCT/US2016/019699

§ 371 (c)(1),
(2) Date: Aug. 24, 2017

(87) PCT Pub. No.: WO2016/138342

PCT Pub. Date: Sep. 1, 2016

(65) Prior Publication Data

US 2018/0016945 A1 Jan. 18, 2018

Related U.S. Application Data

(60) Provisional application No. 62/121,593, filed on Feb. 27, 2015.

(51) Int. Cl.
*F01K 5/02* (2006.01)
*F01K 7/22* (2006.01)

(52) U.S. Cl.
CPC . *F01K 5/02* (2013.01); *F01K 7/22* (2013.01)

(58) Field of Classification Search
CPC combination set(s) only.
See application file for complete search history.

(56) References Cited

U.S. PATENT DOCUMENTS 3,370,829 A 2/1968 Branthin et al.
3,848,416 A 11/1974 Bundy
(Continued)

FOREIGN PATENT DOCUMENTS

CN 203272032 11/2013
CN 103775132 5/2014
(Continued)

OTHER PUBLICATIONS

Andreeva, L., International Search Report and Written Opinion, dated May 19, 2016, Federal Institute of Industrial Property, Moscow, Russia.

*Primary Examiner* — Mark A Laurenzi
*Assistant Examiner* — Shafiq Mian
(74) *Attorney, Agent, or Firm* — Trego, Hines & Ladenheim, PLLC; Brandon Trego; Jonathan Hines

(57) ABSTRACT

An in-situ incremental reheating system configured to increase steam temperature and thermodynamic efficiencies of a steam turbine is disclosed. The system includes a pump; a radiant heater; piping inter-connecting the pump, radiant heater and steam turbine to create a flow circuit; and a heat transfer material configured to flow through the flow circuit and transfer heat directly to steam used in the steam turbine. The pump moves the heat transfer material through the flow circuit and the radiant heater regenerates the heat transfer material after the heat transfer material transfers heat to the steam.

7 Claims, 2 Drawing Sheets

(56) References Cited

U.S. PATENT DOCUMENTS

| | | | | |
|---|---|---|---|---|
| 2005/0194745 | A1* | 9/2005 | Hogg | F16J 15/3292<br>277/301 |
| 2008/0156236 | A1* | 7/2008 | Ito | F23C 6/047<br>110/191 |
| 2010/0183439 | A1* | 7/2010 | Ren | F01D 3/04<br>415/230 |
| 2011/0048011 | A1* | 3/2011 | Okita | F01K 7/18<br>60/649 |
| 2011/0127773 | A1* | 6/2011 | Freund | F01K 23/10<br>290/52 |
| 2011/0247329 | A1* | 10/2011 | Goto | F01K 7/18<br>60/641.15 |
| 2012/0067054 | A1* | 3/2012 | Palmer | F01D 5/085<br>60/772 |
| 2014/0060053 | A1 | 3/2014 | Wolf | |
| 2016/0319703 | A1* | 11/2016 | Burg | F01K 5/02 |
| 2016/0363008 | A1* | 12/2016 | Yokoyama | F01K 7/345<br>110/191 |

FOREIGN PATENT DOCUMENTS

| | | |
|---|---|---|
| EP | 2725205 | 4/2014 |
| GB | 246593 | 2/1926 |
| GB | 743869 | 1/1956 |
| JP | 5669408 | 6/1981 |
| RU | 2010101708 | 7/2011 |

* cited by examiner

REHEATING OF A WORKING FLUID WITHIN A TURBINE SYSTEM FOR POWER GENERATION

BACKGROUND OF THE INVENTION

This invention relates generally to turbine systems used in power generation, and more particularly to a system and method of providing in-situ incremental reheating to increase thermodynamic efficiency of such turbine systems.

The steam-Rankine power cycle is a standard thermodynamic power cycle that converts heat in to power. As such, the efficiency at which it converts heat to power depends most importantly on the temperature to which steam is raised (higher is better) and the temperature at which low-grade heat is removed from the power cycle (lower is better). It has been the historical practice at steam-electric power plants to expand high temperature steam in a high pressure (HP) turbine then reheat the steam before it expands in an intermediate pressure (IP) turbine, FIG. 1. A handful of power plants have employed double reheat in which steam issuing from the IP turbine is reheated again before being sent to a low-pressure (LP) turbine. By increasing the average temperature of heat addition to the steam working fluid, the overall power cycle efficiency and net plant efficiency is increased.

The use of single reheat steam-Rankine power cycles is standard for steam-electric plants greater than about 150 MWe capacity. The increased steam piping/controls costs and the more laborious start-up and shutdown sequences of operations associated with double reheat have limited its acceptance by power plant developer/owners. State of the art steam-electric power plants employ main steam conditions of up to 4000 psia/1120° F. and single reheat temperature of up to 1120° F.

Steam turbines generally consist of alternating stationary (stator) and rotating (rotator) blades arranged in a circle around the turbine shaft. The stationary blades turn and accelerate the steam flow. The steam momentum is transferred to the rotating blades which turn the turbine shaft and, ultimately, the electric generator. A stator with the rotator following, together, make up a single stage of the turbine. Typical HP and LP steam turbines will have in excess of 10 stages in series.

In the last decade the prospect of increasing steam temperatures to as high as 1400° F. and pressures as high as 5100 psia with single reheat temperatures as high as 1400° F. has been investigated. However, increasing steam temperatures above the state of the art 1120° F. requires the use of high nickel alloys not currently used in common steam-electric power plants. These high nickel alloys are required for producing high pressure main steam and reheat steam in final superheater/reheaters to convey the high pressure/temperature steam from the boiler to the turbine.

Unfortunately, suitable high nickel alloys are likely to cost an order of magnitude more than the steels in state of the art power plants. This has led to the pursuit of alternative ways of conveying the high temperature energy from the boiler to the turbine at pressures lower than the main steam pressure, minimizing the strength requirements and hence material quantities required of these exotic metals.

Accordingly, there remains a need for a system and method of increasing steam temperature without the need for expensive alloys and piping.

BRIEF SUMMARY OF THE INVENTION

This need is addressed by the present invention, which provides an in-situ incremental reheating system and method to increase thermodynamic efficiency of turbine systems used in power generation.

According to one aspect of the invention, an in-situ incremental reheating system configured to increase steam temperature and thermodynamic efficiencies of a steam turbine includes a pump; a radiant heater; piping interconnecting the pump, radiant heater and steam turbine to create a flow circuit; and a heat transfer material configured to flow through the flow circuit and transfer heat directly to steam used in the steam turbine. The pump moves the heat transfer material through the flow circuit and the radiant heater regenerates the heat transfer material after the heat transfer material transfers heat to the steam.

According to one aspect of the invention, an in-situ incremental reheating system configured to increase steam temperature and thermodynamic efficiencies of a steam turbine apparatus having a high pressure turbine, an intermediate pressure turbine, and a low pressure turbine, the system includes a flow circuit and a heat transfer material configured to flow through the flow circuit and transfer heat directly to steam used in the steam turbine. The flow circuit includes a pump configured to move fluid through the flow circuit; a radiant heater configured to regenerate the fluid flowing through the flow circuit; internal flow passages extending through turbine stator blades of the steam turbine; and piping inter-connecting the pump, radiant heater and flow passages.

According to another aspect of the invention, a method for increasing steam temperature and thermodynamic efficiencies of a steam turbine includes the steps of providing a flow circuit having a pump, radiant heater, and piping interconnecting the pump and radiant heater to internal passages of the steam turbine; providing a heat transfer material configured to flow through the flow circuit; heating the heat transfer material using the radiant heater; moving the heated heat transfer material through the piping using the pump and into internal passages of a high pressure turbine of the steam turbine, wherein the heated heat transfer material transfers heat directly to steam expanded in the high pressure turbine to increase an average temperature of heat addition; transferring the heated steam to an intermediate pressure turbine of the steam turbine; and transferring the heated steam to a low pressure turbine of the steam turbine.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
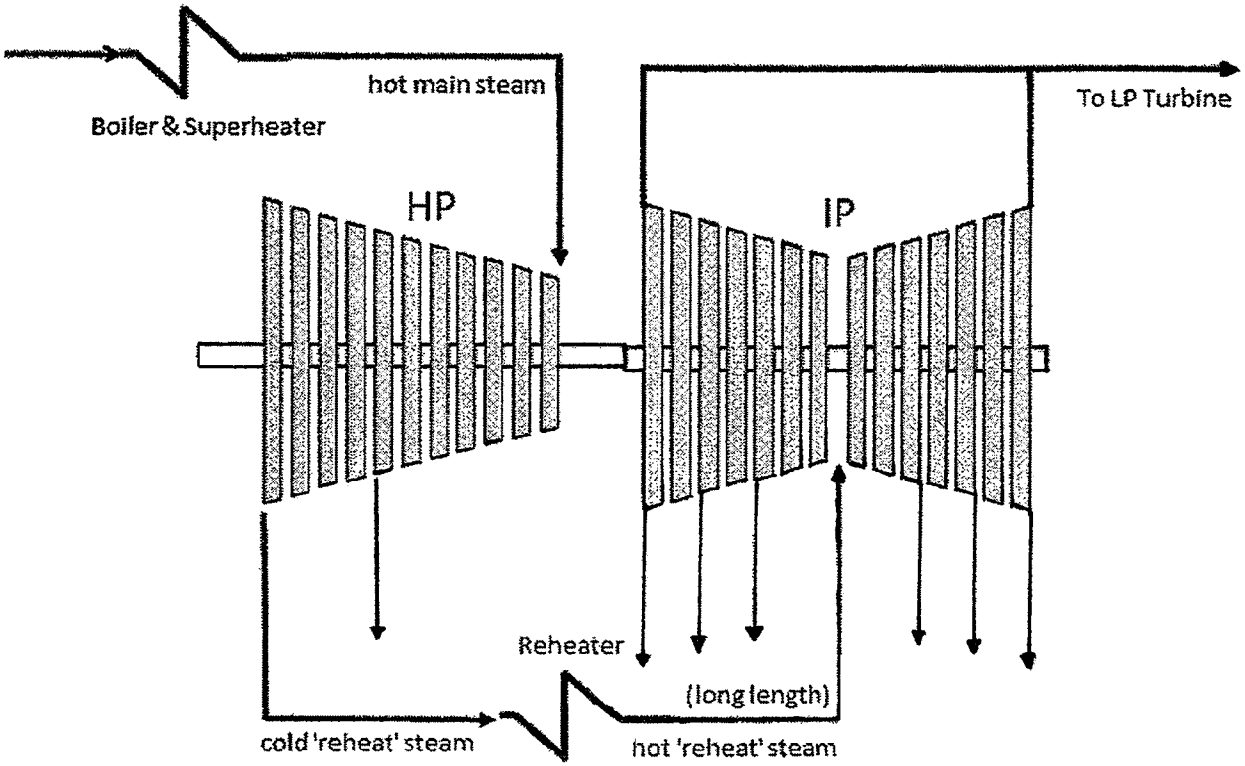
FIG. 1 (PRIOR ART)
FIG. 1 shows a prior art reheating arrangement for a turbine.
Figure 2:
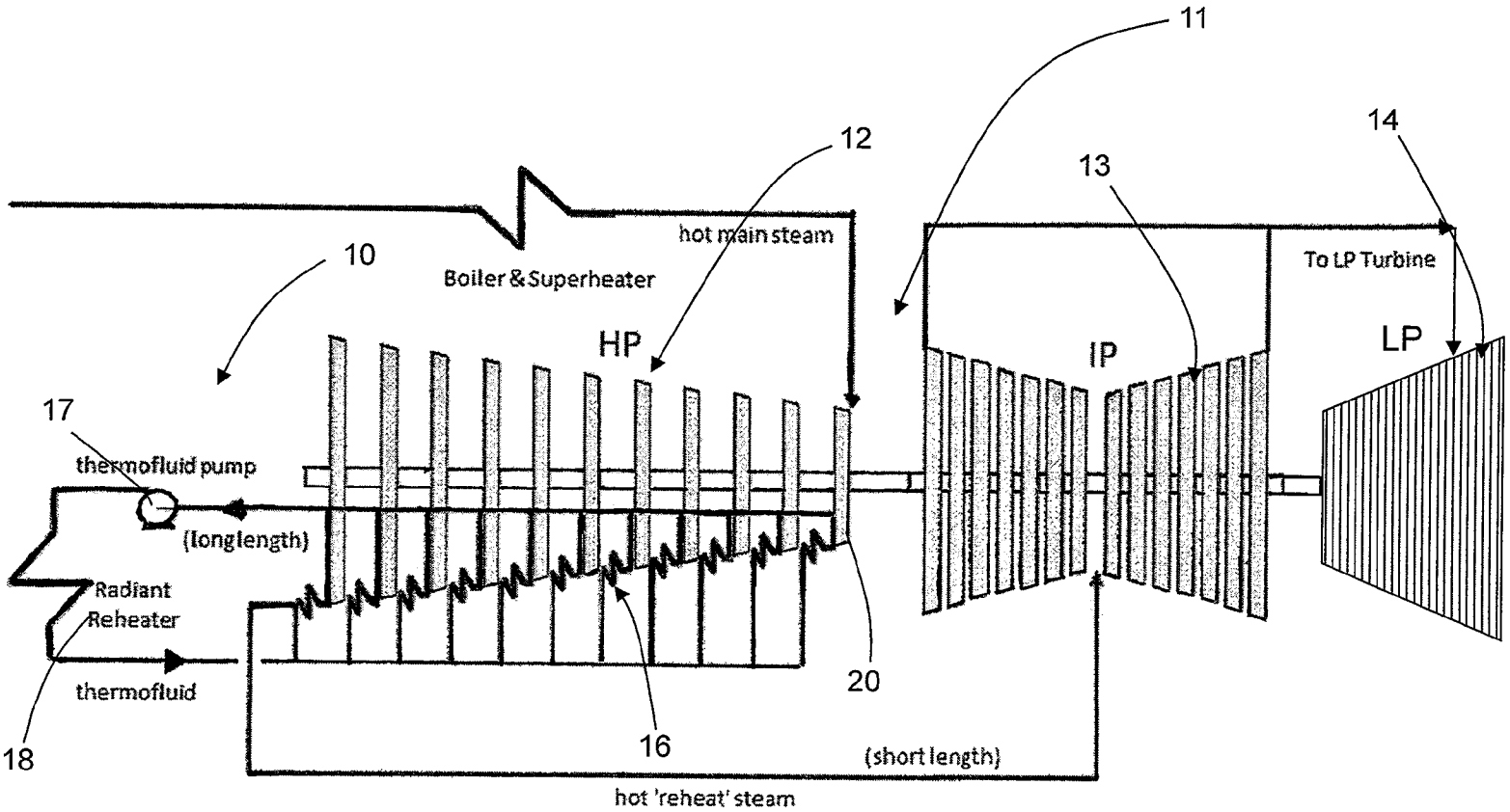
FIG. 2 shows an in-situ incremental reheating system according to an embodiment of the invention.

Referring to the drawings wherein identical reference numerals denote the same elements throughout the various views, FIG. 2 illustrates an in-situ incremental reheating system 10 configured to increase steam temperature and thermodynamic efficiencies of a steam turbine 11. As shown, the steam turbine 11 includes a high pressure (HP) turbine 12, an intermediate pressure (IP) turbine 13, and a low pressure (LP) turbine 14. The system 10 uses an intermediate thermofluid or heat transfer material whose vapor pressure is low at temperatures up to 1400° F. or 760° C. (i.e. liquid salt or metal), allowing the use of relatively thin wall, low-pressure piping. The thermofluid is used to transfer heat directly to steam used in the steam turbine 11 as the steam is expanded in the HP turbine 12, thus producing more power and eliminating the need for a separate reheat circuit as well as reducing the need for costly high nickel alloys required to convey the high temperature steam from a boiler to the turbine.

As illustrated, the thermofluid is circulated through internal flow passages 16 in the turbine stator blades 20 by a pump 17 to transfer heat from the thermofluid to steam expanded in the HP turbine 12. A radiant heater 18 is used to reheat or regenerate the thermofluid back to the desired temperature. The thermofluid is transferred to the turbine 11 at low pressure, requiring minimal thickness piping, where it can be used to continually reheat the working fluid (steam) as it expands through the turbine, eliminating the need for a discrete reheater circuit. This improves the average temperature of heat addition, thereby improving efficiency without increasing the final steam temperature.

Once the steam is heated by the thermofluid, it is transferred to the IP and LP turbines. In general, the current invention increases efficiency by providing a continuous reheat that increases the average temperature of heat addition significantly. For a subcritical steam power cycle (typical of those built in the 1990s), this increase in the average temperature of steam addition may be as much as 60° F. Additionally, the increase efficiency results in an increased turbine output for approximately the same size turbine and boiler (approx. +0.7% age points improvement using the same temperature limits on the steam).

The foregoing has described an in-situ reheating system and method for increasing thermodynamic efficiencies of turbine systems used in power generation. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

We claim:

1. An in-situ incremental reheating system configured to increase steam temperature and thermodynamic efficiencies of a steam turbine apparatus having a high pressure turbine, an intermediate pressure turbine, and a low pressure turbine, of the type in which steam from a boiler is provided to the high pressure turbine and spent steam from the high pressure turbine is provided to the intermediate pressure turbine, the reheating system comprising:

(a) a flow circuit having:
  (i) a pump configured to move fluid through the flow circuit;
  (ii) a radiant heater configured to regenerate the fluid flowing through the flow circuit;
  (iii) internal flow passages extending through turbine stator blades of the high pressure turbine; and
  (iv) piping inter-connecting the pump, the radiant heater and the internal flow passages; and
(b) a heat transfer material configured to flow through the internal flow passages and transfer heat directly to steam used in the high pressure turbine.

2. The reheating system of claim 1, wherein the heat transfer material is a liquid salt.

3. The reheating system of claim 1, wherein the heat transfer material is a liquid metal.

4. The reheating system of claim 1, wherein the heat transfer material is heated up to a temperature of 1400 degrees Fahrenheit (760 degrees Celsius).

5. A method for increasing steam temperature and thermodynamic efficiencies of a steam turbine apparatus having a high pressure turbine, an intermediate pressure turbine, and a low pressure turbine, comprising the steps of:

(a) providing a flow circuit having a pump, a radiant heater, and piping interconnecting the pump and the radiant heater to internal passages of the high pressure turbine;
(b) providing a heat transfer material configured to flow through the internal passages;
(c) heating the heat transfer material using the radiant heater;
(d) moving the heated heat transfer material through the piping using the pump and into the internal passages, wherein the heated heat transfer material transfers heat directly to steam expanded in the high pressure turbine to increase an average temperature of heat addition;
(e) transferring the heated steam to an intermediate pressure turbine of the steam turbine; and
(f) transferring the heated steam to a low pressure turbine of the steam turbine.

6. The method of claim 5, further including the step of repeating steps (c) and (d) to provide continual heat addition to the steam expanded in the high pressure turbine.

7. The method according to claim 5, wherein the step of heating includes the step of heating the heat transfer material up to a temperature of 1400 degrees Fahrenheit (760 degrees Celsius).

* * * * *